United States Patent [19]

Heine

[11] Patent Number: 4,613,834

[45] Date of Patent: Sep. 23, 1986

[54] MICROWAVE SLOT LINE RING HYBRID HAVING ARMS WHICH ARE HF COUPLED TO THE SLOT LINE RING

[75] Inventor: Wilfried Heine, Backnang, Fed. Rep. of Germany

[73] Assignee: Ant Nachrichtentechnik GmbH, Backnang, Fed. Rep. of Germany

[21] Appl. No.: 564,722

[22] Filed: Dec. 23, 1983

[30] Foreign Application Priority Data

Dec. 30, 1982 [DE] Fed. Rep. of Germany ..... 3248641

[51] Int. Cl.[4] ..... H01P 5/22

[52] U.S. Cl. ..... 333/120; 333/246

[58] Field of Search ..... 333/120, 117, 116, 136, 333/246, 238, 161

[56] References Cited

U.S. PATENT DOCUMENTS 2,749,521 6/1956 Engelmann et al. ..... 333/120
3,772,599 11/1973 Ernst et al. ..... 333/238 X
3,946,339 3/1976 Oltman, Jr. et al. ..... 333/121

FOREIGN PATENT DOCUMENTS 2607634 9/1977 Fed. Rep. of Germany .
54-101615 8/1979 Japan .
0097204 6/1982 Japan ..... 333/120

OTHER PUBLICATIONS

Konrad Abel et al., Sender and Empfänger der Breitband-Richtfunksysteme; Siemens-Zeitschrift 48 (1974) Beiheft Nachrichten-Übertragungstechnik; pp. 160-164.

Ogawa et al; "K-Band Integrated Double Balance Mixer"; *IEEE Transaction on Microwave Theory and Techniques;* vol. MTT-28, No. 3, Mar. 1980; pp. 180-185.

*Primary Examiner*—Eugene R. LaRoche
*Assistant Examiner*—B. Lee
*Attorney, Agent, or Firm*—Spencer & Frank

[57] ABSTRACT

A microwave ring hybrid on a dielectric carrier substrate is provided with connecting arms designed in microstrip technique. The ring of the hybrid comprises a slit line made in a conductive layer on the side of the carrier substrate opposite that on which the strip conductors of the microstrip lines for the connecting arms are disposed.

18 Claims, 6 Drawing Figures

MICROWAVE SLOT LINE RING HYBRID HAVING ARMS WHICH ARE HF COUPLED TO THE SLOT LINE RING

BACKGROUND OF THE INVENTION

The present invention relates to a microwave ring hybrid whose connecting arms are designed in the microstrip technique and are provided on one side of a dielectric substrate.

A ring hybrid of the above type is known, for example, from Siemens Zeitschrift 48 [Siemens Magazine] (1974), Addendum issue entitled "Nachrichten-Übertragungstechnik" [communications transmission art], page 162, FIG. 8. This ring hybrid is constructed completely in the microstrip technique on one side of a ceramic substrate. The connecting arms are galvanically, i.e. conductively, coupled so that, for example if the ring hybrid is used to connect two amplifier modules in parallel, additional networks to galvanically decouple the connecting arms, such as, for example, chip capacitors or fingers couplers must additionally be provided. These additional components may interfere with the symmetry and matching of the ring hybrids and may thus cause reflections and losses.

SUMMARY OF THE INVENTION

It is therefore the object of the present invention to design a microwave ring hybrid of the type whose connecting arms are designed in the microwave technique and are provided on one side of a dielectric substrate in such a manner that all connecting arms are galvanically separated from one another without the use of additional components.

The above object is achieved according to the present invention by a microwave ring hybrid which comprises: a dielectric carrier substrate; a conductive layer disposed on one major surface of the substrate; a ring for the hybrid comprised of a annular closed slot line formed by a slit or slot in the conductive layer; and a plurality of connecting arms for the hybrid with each of the connecting arms being a microstrip line including a conductor disposed on the opposite major surface of the carrier substrate such that the slot line is coupled with each of the microstrip lines in a high frequency manner i.e., via the E-field component.

According to various features of the invention, the high frequency coupled components of the connecting arms, in the form of microstrip lines, and the ring, designed as a slot line, intersect perpendicularly; the microstrip lines of at least two connecting arms extend into the region enclosed by the ring by a $\lambda/4$ section; and the microstrip line of one connecting arm has one line end extending into the region enclosed by the ring by a further $\lambda/4$ section or connected with the conductive layer on the opposite surface of the substrate, and its other line end projecting outwardly from the ring by a $\lambda/4$ section.

Couplings between slot lines and microstrip lines are known, for example from Federal Republic of Germany Offenlegungsschrift (laid open application) DE-OS 2,607,634. However, that publication does not disclose a suggestion of how to realize a microwave ring hybrid with galvanic decoupling of all connecting arms without any additional decoupling measures.

The present invention provides significant advantages in that, in spite of the galvanic decoupling of all connecting arms, all inputs and outputs of the ring hybrid are disposed on one side of the carrier substrate. Thus, the modules to be connected with the ring hybrid can all be disposed on one side of the carrier substrate. The slot line, which due to its unfavorable radiation behavior must not be coupled with radiation sensitive components, is disposed on the side of the carrier substrate facing away from these modules and thus provides hardly any interference. A further advantage is that the side of the carrier substrate on which the slot line is disposed is provided with a closed conductive layer except for the "interference location-slot line " and thus shields against radiation from the components connected with the ring hybrid in the direction of the carrier substrate. Adjacent microwave components can thus be brought into the vicinity of this conductive layer without being subjected to significant interference radiation. The packing density of microwave circuits can thus be increased considerably.

DETAILED DESCRIPTION OF THE PREFERRED EMBODIMENT

Figure 1:
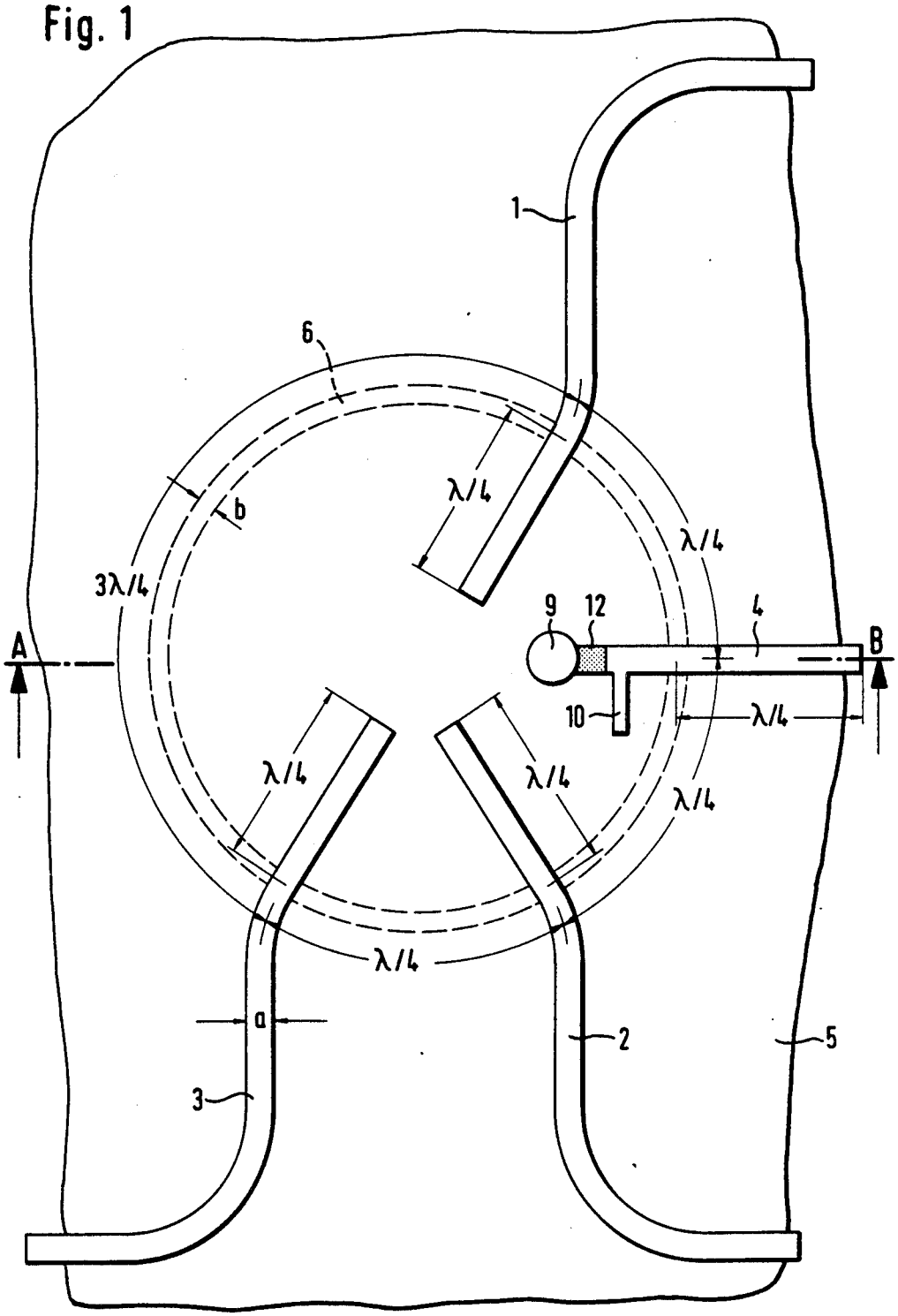
FIG. 1 is a top view of a 180° ring hybrid according to the present invention.
Figure 2:
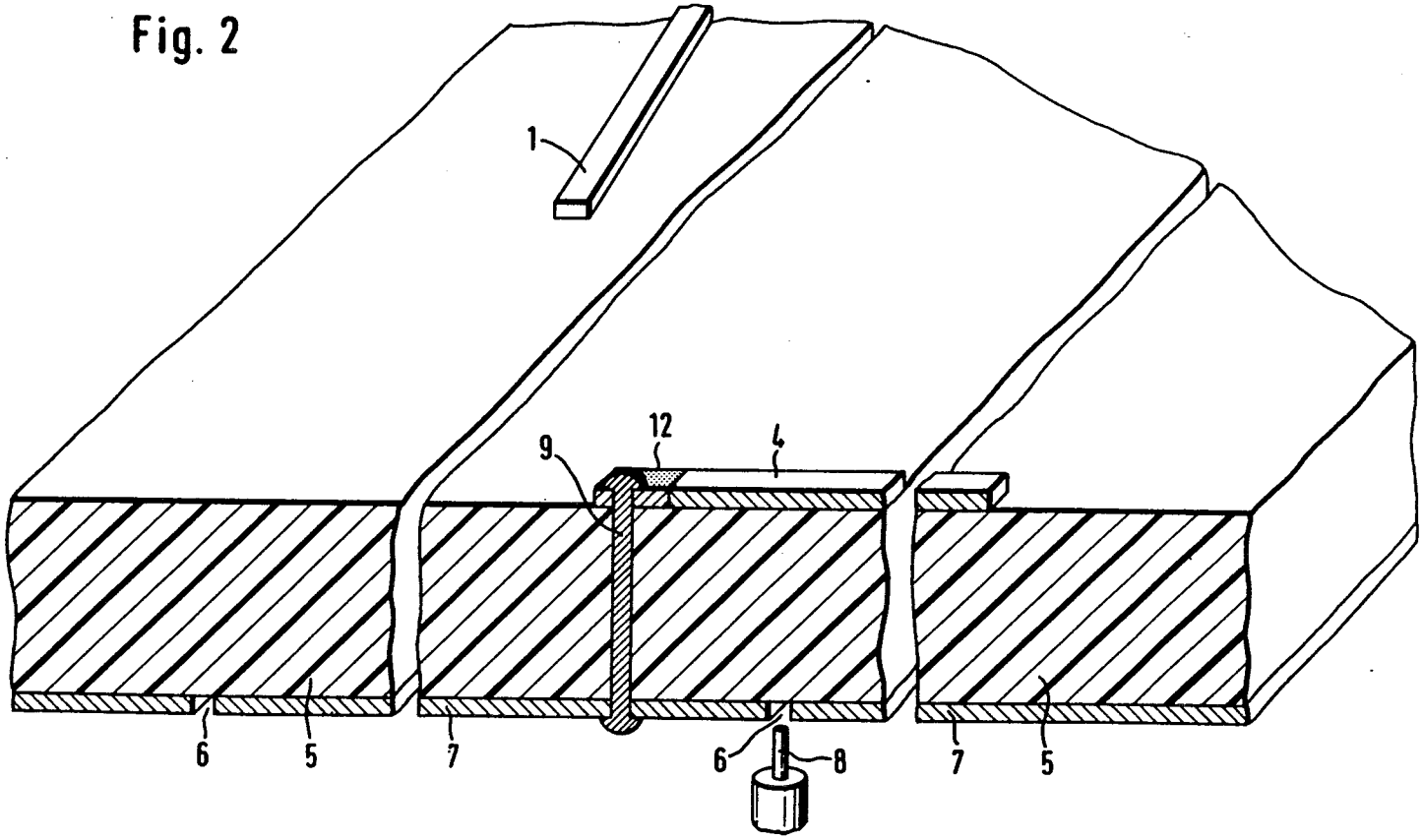
FIG. 2 is a sectional view in the direction A-B of FIG. 1.

Referring now to FIG. 1, there is shown a ring hybrid having four connecting arms which are designed in the microstrip technique. The four connecting arms include respective strip conductors 1, 2, 3 or 4 which are disposed on the top surface of a dielectric carrier substrate 5 whose bottom or other major surface is provided with a conductive layer 7 (FIG. 2). Ring 6 of the ring hybrid comprises a closed annular slot line formed in the conductive layer 7 on the underside of the carrier substrate 5. To provide the desired coupling between the coupling arms and the ring, the conductors 1, 2, 3 and 4 crossover or intersect the ring 6 in the coupling region, preferably in a direction perpendicular to the circumference of the ring 6 as shown. The conductors 1, 2, 3 and 4 of the respective connecting arms are distributed over the circumference of ring 6, which has a total circumference of $3\lambda/2$, (where $\lambda$ is the wavelength of the center frequency of the hybrid), in the manner of a conventional 180° ring hybrid. That is, the spacing along the circumference of ring 6 between the the conductors 1 and 3 of two of the connecting arms is $3\lambda/4$, and the conductors 2 and 4 of the other connecting arms each are spaced by $\lambda/4$ from the adjacent connecting arms on the circumference of ring 6. One end of the microstrip lines of the connecting arms including the conductors 1, 2 and 3 extends by $\lambda/4$ into the region enclosed by the ring 6, and thus provides for suitable transformation between the slot line and the microstrip lines in the coupling region. The line lengths of $\lambda/4$, $3\lambda/4$, $3\lambda/2$ may each by multiplied by a factor $n(n=1, 2, 3, \ldots)$. The design configuration of the remaining connecting arm, i.e., the arm including the strip conductor 4, which is preferably equipped with an absorber, or resistance layer 12 may be effected in various ways. One end of the conductor 4, and thus of the resulting microstrip line, can extend into the region enclosed by the ringy be a λ/4 line section on one side of the ring crossover while the other end of conductor 4 projects outwardly by such a λ/4 line section from the line crossover. Alternatively, as shown in FIG. 1, one end of the conductor 4 projects outwardly from the region enclosed by the ring 6 by a λ/4 section while the other end is connected to the absorber or resistance layer 12 and then by means of a rivet 9 with the conductive layer 7 (see FIG. 2) on the underside of the carrier substrate 5. To compensate for series inductance in the absorber, the end portion of conductor 4 extending into the region enclosed by the ring 6 is equipped with a parallel capacitance in the form of a laterally extending strip conductor portion 10.

FIG. 2, which is a sectional view of the ring hybrid of FIG. 1, shows the slot line 6 formed in the conductive layer 7. The width b (see FIG. 1) of the annular slit 6 with respect to the width a of the conductors 1–4 of the microstrip line has, as is known for 180° ring hybrids, the ratio of a:b=2:1. As further shown in FIG. 2, tuning elements 8 may be provided adjacent the slot line 6 in the region where the respective conductors 1–4 of the crossover of the slot line 6.

Figure 4:
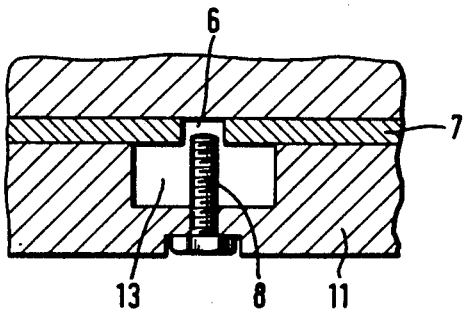
FIG. 4 is a sectional view of the slot line with a tuning element.

Tuning elements 8 may be screws which, according to FIG. 4, could be fixed in a housing 11. Housing 11 is in electrical contact with conductive layer 7 and shows grooves 13 close to the annular slot 6, so that the annular slot 6 is only influenced by the screws 8. With the tuning elements 8, a better rf coupling of the high impedance slot and the strip conductors can be achieved.

A ring hybrid according to FIG. 1 designed for a center frequency of 6 GHz attained a relative bandwidth of 15 %. The characteristic impedance of the microstrip lines is preferably selected to be 50 ohm. This results in a characteristic impedance of 71 ohm for the slot line 6.

FIGS. 1 and 2, which are not drawn to scale, show a 180° ring hybrid with the following specifications:

The ceramic substrate 5 is formed of a composition of $Al_2O_3$ with a relative capacitivity of (relative dielectric constant) of $\epsilon_r=9.8$. The thickness of this substrate is 0.625 mm (25 mil). Conductors 1–4 are of gold with a thickness of 5 μm and a width of 0.53 mm. The λ/3 sections of conductors 1–3 within the ring have a length of 4.9 mm. The part of conductor 4 projecting out of the ring region has a length of λ/4 (4.9 mm). Within the ring region, conductor 4 is for convenient reasons 1 mm long and has a width of 0.53 mm. The laterally extending strip conductor portion 10 is about 1.1 mm long and has a width of 0.2 mm. Between the end of conductor 4 and rivet 9, FIG. 1 shows resistance layer 12 of tantalum nitride $Ta_3N_5$, which is about 0.6 mm long and has a width of 0.53 mm.

Conductive layer 7 is a gold layer with a thickness of 5 μm. Slot line 6 has a width of around 60 μm. The diameter d of slot line 6 is given by the formula:

$$d = \frac{3\lambda}{2\pi},$$

wherein λ is 24 mm.

Figure 3:
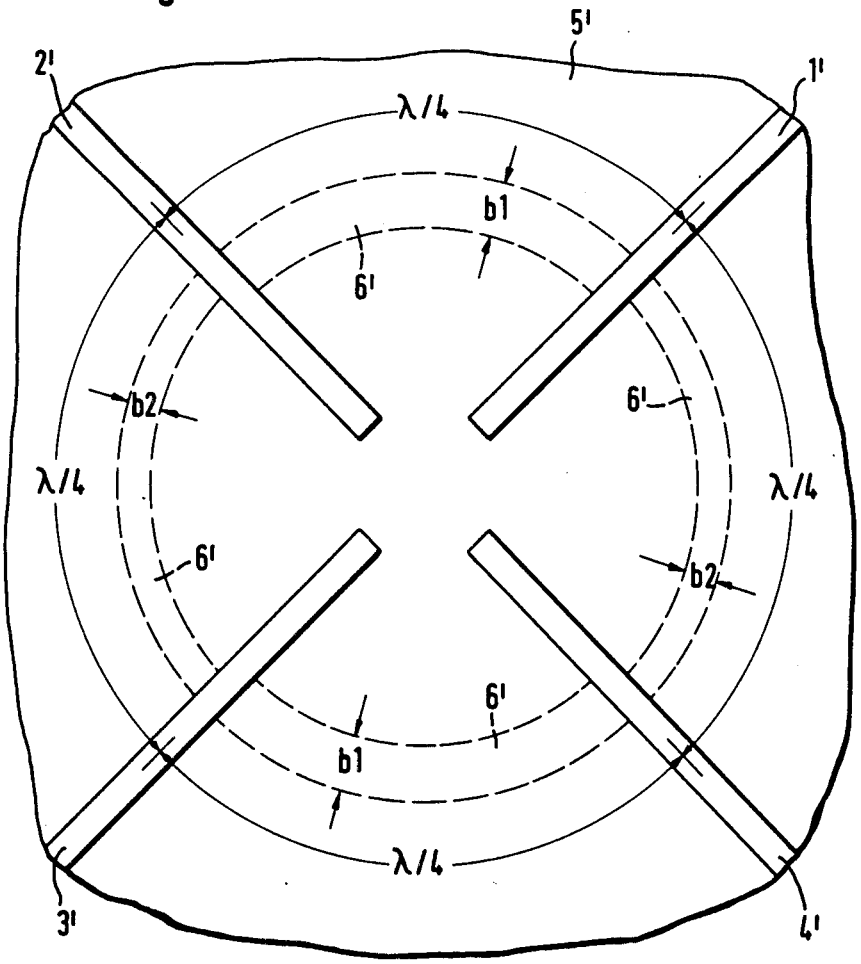
FIG. 3 is a top view of a 90° ring hybrid according to FIG. 1 of the invention.
Figure 5:
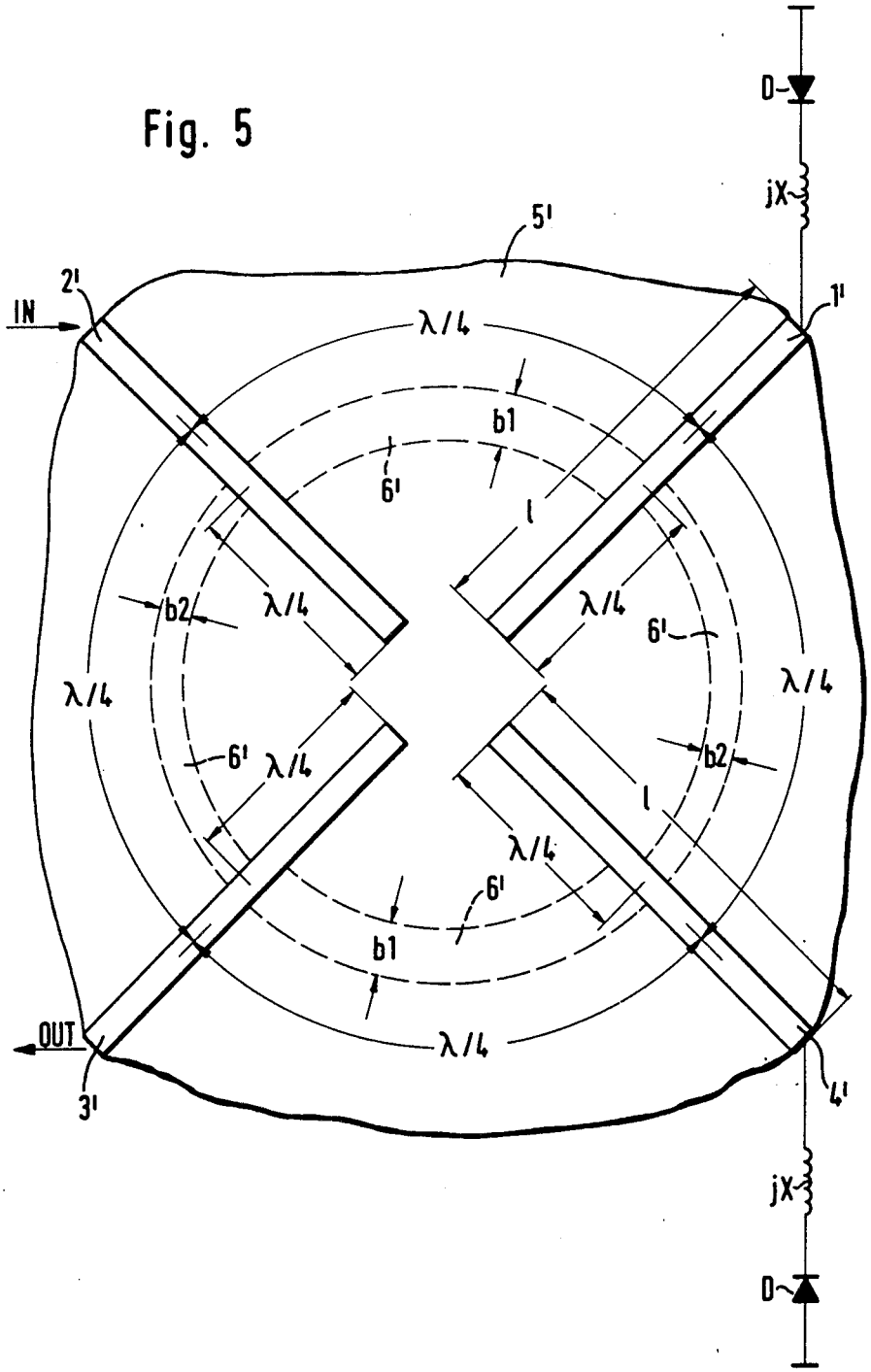
FIG. 5 is an application of a 90° ring hybrid as a phaseshifter.

In connection with the above described embodiment, only a 180° ring hybrid was shown. FIG. 3 shows an embodiment for 90° ring hybrid. The conductors 1', 2', 3' and 4' of the connecting arms are distributed over the circumference of the ring 6', which is designed in the slot line technique, at equal distances of λ/4. The conductors of the connecting arms again cross over ring 6' perpendicularly. The conductors 1', 2', 3' and 4' of the respective connection arms project by a λ/4 section into the region enclosed by the ring 6'. The lengths of conductors 1', 2', 3' and 4' on either side of the crossover depend on the application. FIG. 5 shows an application of a 90° ring hybrid as a phaseshifter. An input signal is fed to conductor 2'. Conductors 3'and 4'are of identical length and are coupled to identical impedances jX in series with varactors D. Conductor 3' will provide the phase shifted output signal.

The characteristic impedance $Z_O$ of the microstrip lines including conductors 1', 2', 3' and 4' is assumed to be for example, 50 ohm. Widths of these conductors are again 0.53 mm. Ring 6', again formed in slot line technique on the underside of carrier substrate 5', is provided with slot line portions of various widths. The width b1 is around 80 μm and the width b2 around 60 μm. Between the crossovers of the connecting arms including strip conductors 1' and 2' as well as between the crossovers of the connecting arms including strip conductors 3' and 4', the width b1 of the slot line 6' is selected to be such that it has a characteristic impedance of, for example, 35 ohm. Between the connecting arms including the conductors 2' and 4' and between the connecting arms including the conductors 1' and 3', the width b2 of the slot line 6' is selected so as to provide a characteristic impedance of $Z_O$, i.e. for example, 50 ohm. In the region of the crossovers, tuning elements, such a elements 8 of FIG. 2, may be applied as before.

Figure 6:
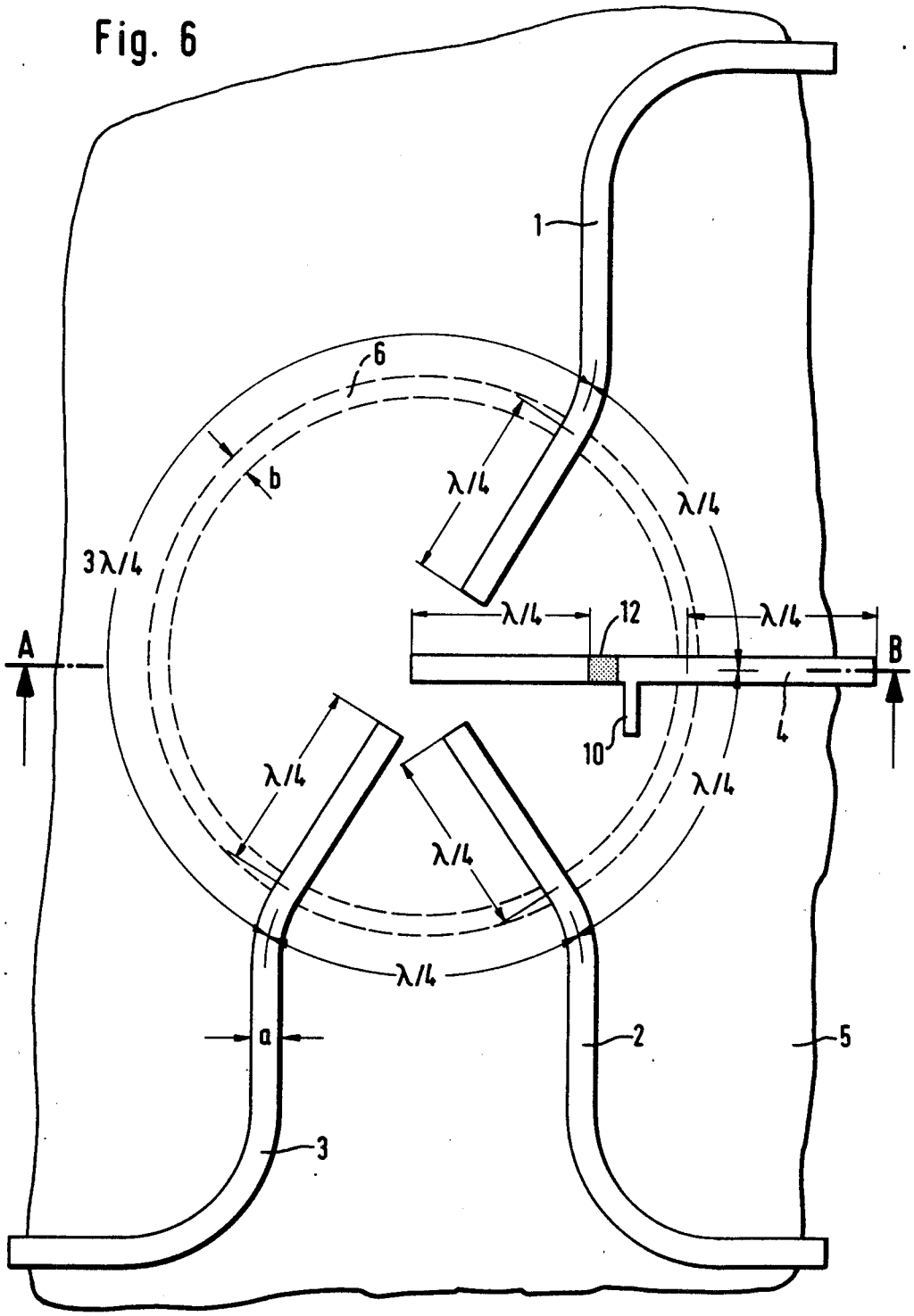
FIG. 6 is a top view of a modified 180° ring hybrid.

FIG. 6 shows a modified 180° ring hybrid. Conductor 4 projects beyond the resistance layer 12 by a λ/4 section into the ring region, whereas the length of conductor 4 on the other side of the crossover is, as shown in FIG. 1, also λ/4. Resistance layer 12 and the laterally extending strip conductor portion 10 (capacitive stub) are the same as in FIG. 1.

It will be understood that the above description of the present invention is susceptible to various modifications, changes and adaptations, and the same are intended to be comprehended within the meaning and range of equivalents of the appended claims.

What is claimed is:

1. A microwave ring hybrid comprising:

a dielectric carrier substrate; a conductive layer disposed on one major surface of said substrate; a ring for said hybrid including an annular closed slot line formed by an annular slot in said conductive layer; and a plurality of connecting arms of said hybrid, with each of said connecting arms being a microstrip line including a conductor disposed on the opposite major surface of said carrier substrate such that said conductors crossover said annular slot line in a direction substantially perpendicular to the circumference of said slot line and are coupled with said slot line in the region of said crossovers; and wherein said conductors of said microstrip lines of at least two of said connecting arms extend from said slot line into the region enclosed by said slot line by a section of a length of λ/4, where λ is the wavelength of the center frequency of the hybrid in the respective said microstrip line.

2. A microwave ring hybrid as defined in claim 1 wherein said conductor of said microstrip line of a further one of said connecting arms has one end projecting outwardly from said slot line by a section of a length of λ/4 and has its other end connected through said substrate to said conductive layer on said one major surface of said carrier substrate.

3. A microwave ring hybrid as defined in claim 2 wherein: said ring hybrid is a 180° ring hybrid; said at least two connecting arms comprise first, second and third of said connecting arms; said slot line has a circumference of 3λ'/2, where λ' is the wavelength of the center frequency of the hybrid in said slot line; and said connecting arms are spaced about the circumference of said slot line such that said further one of said connecting arms is spaced from each of the adjacent said first and second of said connecting arms by λ'/4, said second of said connecting arms is spaced from said third of said connecting arms by λ'/4, and said first and said third of said connecting arms are spaced by 3λ'/4.

4. A microwave ring hybrid as defined in claim 2 wherein said other end of said conductor of said further one of said connecting arms is connected to said conductive layer via a resistance layer disposed on said opposite major surface adjacent and contacting said other end and a metal conductor extending through an opening in said substrate and electrically connecting said conductive layer and said resistance layer.

5. A microwave ring hybrid comprising:

a dielectric carrier substrate; a conductive layer disposed on one major surface of said substrate; a ring for said hybrid including an annular closed slot line formed by an annular slot in said conductive layer, said slot line having a circumference of λ, where λ is the wavelength of the center frequency of said hybrid in said slot line; and four connecting arms, for said hybrid, with each of said connecting arms being a microstrip line including a conductor disposed on the opposite major surface of said carrier substrate such that it crosses over said annular slot line in a direction substantially perpendicular to the circumference of said slot line and is coupled with said slot line in the region of said crossover, and with said four connecting arms being spaced about said circumference of said slot line such that the spacing between adjacent connecting arms is λ/4.

6. A microwave ring hybrid as defined in claim 5 wherein each of said conductors of said microstrip lines of said connecting arms extends from said slot line into the region enclosed by said slot line by a section having a length of λ'/4, where λ' is the wavelength of the center frequency of said hybrid in the respective said microstrip line.

7. A microwave ring hybrid as defined in claim 6 wherein the width of the portion of said annular slot line between each adjacent pair of said conductors is constant but is different on either side of each said conductor.

8. A microwave 180° ring hybrid comprising:

a dielectric carrier substrate; a conductive layer disposed on one major surface of said substrate; a ring for said hybrid including an annular slot line having a circumference of 3λ/2 formed by an annular slit in said conductive layer, where λ is the wavelength of the center frequency of said hybrid in said slot line; and first, second, third and fourth connecting arms for said hybrid, each of said four connecting arms being a microstrip line including a conductor disposed on the opposite major surface of said carrier substrate such that it crosses over said ring formed by said slot line in a direction substantially perpendicularly to said circumference of said slot line and is coupled with said slot line in the region of said crossover, and said connecting arms are spaced about said circumference such that said first and second connecting arms are spaced by 3λ/4 from each other and said third and fourth connecting arms are spaced by λ/4 from each other and from a respective adjacent one of said first and second connecting arms.

9. A microwave 180° ring hybrid as defined in claim 8 wherein said slot line is formed by a closed annular slit in said conductive layer.

10. A microwave ring hybrid as defined in claim 8 wherein said conductor of said microstrip line of one of said connecting arms has one end which extends into the region enclosed by said slot line and which is connected via a resistance layer to a conductor section of a length of λ'/4 disposed on said opposite major surface, where λ' is the wavelength of the center frequency of the hybrid in said microstrip line of said one of said connecting arms, and has its other end projecting outwardly from said slot line by a section of a length of λ'/4.

11. A microwave ring hybrid as defined in claim 8 wherein said conductors of said microstrip lines of at least said first and second of said connecting arms extend from said slot line into the region enclosed by said slot line by a section of a length of λ'/4, where λ' is the wavelength of the center frequency of the hybrid in the respective said microstrip line.

12. A microwave 180° ring hybrid as defined in claim 11 wherein said conductor of said microstrip line of said third connecting arm likewise extends from said slot line into the region enclosed by said slot line by a section of a length of λ'/4 and said conductor of said microstrip line of said fourth connecting arm has one end projecting outwardly from said slot line by a section of a length of λ'/4, and has its other end connected via a resistance layer disposed on said other major surface to a conductor section of a length of λ'/4 likewise disposed on said other major surface.

13. A microwave 180° ring hybrid as defined in claim 11 wherein said conductor of said microstrip line of said third connecting arm likewise extends from said slot line into the region enclosed by said slot line by a section of a length of λ'/4 and said conductor of said microstrip line of said fourth connecting arm has one end projecting outwardly from said slot line by a section of a length of λ'/4, and has its other end connected with said conductive layer on said one major surface of said carrier substrate.

14. A microwave ring hybrid as defined in claim 13 wherein tuning elements are provided adjacent said slot line in the region of said crossovers of said slot line.

15. A microwave ring hybrid comprising:

a dielectric carrier substrate; a conductive layer disposed on one major surface of said substrate; a ring for said hybrid including an annular slot line having a circumference of λ formed by an annular slit in said conductive layer, where λ is the wavelength of the center frequency of said hybrid in said slot line; and four connecting arms of said hybrid, each of said connecting arms being a microstrip line including a conductor disposed on the opposite major surface of said carrier substrate such that it crosses over said ring formed by said slot line in a direction substantially perpendicularly to said circumference of said slot line and is high frequency coupled with said slot line in the region of said crossover, said connecting arms being distributed over said circumference such that each of said connecting arms is spaced from the adjacent said arms by a distance of $\lambda/4$ along said circumference.

16. A microwave 90° ring hybrid as defined in claim 15 wherein each of said conductors of said microstrip lines of said connecting arms extends from said slot line into the region enclosed by said slot line by a section of a length of $\lambda'/4$ where $\lambda'$ is the wavelength of the center frequency of said hybrid in the respective said microstrip lines.

17. A microwave 90° ring hybrid as defined in claim 16 wherein the width of said slot line between each pair of said connecting arms is different than the width of said slot line between each adjacent pair of said connecting arms and the same as the width of said slot line between the opposite pair of said connecting arms.

18. A microwave 90° ring hybrid as defined in claim 17 wherein tuning elements are selectively provided adjacent said slot line in the region of said crossovers of said slit of said slot line.

* * * * *